US009381392B2

(12) United States Patent
Behle et al.

(10) Patent No.: US 9,381,392 B2
(45) Date of Patent: Jul. 5, 2016

(54) WEIGHT PLATE LOCKING HUB

(71) Applicant: S. Tyler Behle, Saratoga Springs, UT (US)

(72) Inventors: S. Tyler Behle, Saratoga Springs, UT (US); Ryan D. Cook, Morgan, UT (US)

(73) Assignee: Tyler S. Behle, Saratoga Springs, UT (US)

( * ) Notice: Subject to any disclaimer, the term of this patent is extended or adjusted under 35 U.S.C. 154(b) by 0 days.

(21) Appl. No.: 14/494,468

(22) Filed: Sep. 23, 2014

(65) Prior Publication Data

US 2016/0082304 A1 Mar. 24, 2016

(51) Int. Cl.
*A63B 21/072* (2006.01)

(52) U.S. Cl.
CPC ..... *A63B 21/0728* (2013.01)

(58) Field of Classification Search
CPC ..... A63B 21/012–21/0125; A63B 21/015; A63B 21/072; A63B 21/0726; A63B 21/0728; F16B 3/00; F16B 21/18; Y10T 403/7026; Y10T 403/7033
See application file for complete search history.

(56) References Cited

U.S. PATENT DOCUMENTS 5,603,680 A * 2/1997 Larsen ..... A63B 21/0728 24/523
5,853,355 A 12/1998 Standish
6,007,268 A * 12/1999 Whittington ..... A63B 21/0728 403/110
6,436,015 B1 8/2002 Frasco et al.
D474,517 S 5/2003 Harms
6,746,380 B2 6/2004 Lien et al.
6,991,590 B2 1/2006 Vigiano
7,198,591 B2 4/2007 Lien
7,207,929 B2 4/2007 Hamilton
7,300,389 B2 11/2007 Lien et al.
7,704,196 B2 4/2010 Lien et al.
7,828,702 B2 11/2010 Lien et al.
2009/0227431 A1 9/2009 Hsieh et al.
2014/0162855 A1 6/2014 Beckman
2014/0256521 A1 * 9/2014 Davies, III ..... A63B 21/0728 482/107

FOREIGN PATENT DOCUMENTS

WO 2012026834 A1 3/2012

* cited by examiner

*Primary Examiner* — Oren Ginsberg
*Assistant Examiner* — Jennifer M Deichl
(74) *Attorney, Agent, or Firm* — Workman Nydegger

(57) ABSTRACT

Implementations of the present invention relate to devices, systems, and methods for the safe and efficient use of exercise equipment and, in particular, weight training equipment. A locking hub for weight training equipment may include a first hub and second hub, the first hub and second hub having a sleeve located therebetween. The first hub and/or second hub may hold one or more pads adjacent the sleeve. Rotation of the sleeve relative to the first hub and/or the second hub may compress the one or more pads to force the pads radially inward against a weight bar, substantially restricting movement of the locking hub relative to the weight bar.

6 Claims, 8 Drawing Sheets

WEIGHT PLATE LOCKING HUB

CROSS-REFERENCE TO RELATED APPLICATIONS

N/A

BACKGROUND OF THE DISCLOSURE

Free weights provide weight resistance during strength training exercises. For example, a strength training device or system may include a bar having a grip in the center and weight loading areas on either side of the grip. A user may load one or more weight plates onto the weight loading areas to increase the weight of the bar. The user may load the weight plates onto the bar such that there is an equal weight distribution on either side of the grip. An equal weight distribution will minimize the torque placed on the bar and balance the bar during the weight training exercises. Lateral movement of the weight plates before and/or during the exercise may make the bar more difficult for a user to control during the exercise and may create additional risks to the user, individuals in the vicinity, or surrounding objects.

In a fitness center or gym, the space between exercise equipment may be limited. A poorly-controlled bar and/or weights may create a hazard to the user or other individuals in the gym. In the case of commercial gyms, the increased risk created by a poorly-controlled bar and/or weights may, in turn, increase liability for the gym.

Bar clamps are often used to restrict the lateral movement of weight plates on a bar. The bar clamps may be added to either end of the bar near or abutting the weight plates. The bar clamps may be, for example, a spring clamp that a user may expand to slide over the end of the bar, place adjacent the weight plates, and then release to allow the spring clamp to constrict onto the bar. Other clamps commonly used to restrict the lateral movement of weights on a bar include screw clamps. A user may slide a screw clamp over the end of the bar, place it next to the weights, and then tighten a screw in the clamp that secures the claim in place on the bar. Both screw and spring bar clamps are separate components from the bar and from the weight plates that must be completely removed from and replaced on the bar to remove or change weight plates. These bar clamps are also stored separately between usages of the bar and weight plates. However, the complete removal of the bar clamps from the bar each time a user removes or changes the weight plates increases the chance that the bar clamps may be lost or broken. Additionally, to save costs and reduce clutter, gyms typically have a limited number of bar clamps available for use. Given the limited number of bar clamps, users often do not take the time to locate them if they are not readily available at the station at which the user is loading his or her weights. Additionally, bar clamps and spring clamps can become stiff, thereby making them difficult for users to properly place and secure on the bar. Further, users who are performing sets of exercises successively with minimum rest time between sets, commonly referred to as performing "super sets," often do not use bar or spring clamps because they increase the time required to change the weights in between sets. In view of these and other limitations of conventional screw and spring clamps, a need exists for an improved device and system for limiting the lateral movement of weights on a bar.

BRIEF SUMMARY OF THE DISCLOSURE

This summary is provided to introduce a selection of concepts that are further described below in the detailed description. This summary is not intended to identify specific features of the claimed subject matter, nor is it intended to be used as an aid in limiting the scope of the claimed subject matter.

In a first non-limiting embodiment, a locking hub includes a first and second hub, each hub having an outer axial surface and an inner axial surface, and sharing a longitudinal axis. The first hub includes extensions that may interlock with extensions on the second hub when inserted into a sleeve. An axial bore extends through the first hub, second hub, and the sleeve along the longitudinal axis. The sleeve is rotatable relative to the first hub and second hub, and the sleeve has an inner radial surface and an outer radial surface. At least a first portion of the inner radial surface has a first radius relative to the longitudinal axis and at least a second portion of the inner radial surface has a second radius relative to the longitudinal axis. The first radius is greater than the second radius. The locking hub also includes at least one pad between the sleeve and the first hub or the second hub. The at least one pad has a compressed state and a relaxed state. The at least one pad is in the compressed state when rotationally aligned with the second portion of the sleeve and in the relaxed state when rotationally aligned with the first portion of the sleeve.

In a second non-limiting embodiment, a system may include a locking hub, a weight plate, and a weight bar. The locking hub includes a first and second hub, each having an outer axial surface and an inner axial surface, and sharing a longitudinal axis. The first hub includes extensions that may interlock with extensions on the second hub when inserted into a sleeve. The inner axial surfaces of the two hubs oppose one another and the sleeve is located between the hubs. An axial bore extends through the first hub, second hub, and the sleeve along the longitudinal axis. The sleeve is rotatable relative to the first hub and second hub, and the sleeve has an inner radial surface and an outer radial surface. At least a first portion of the inner radial surface has a first radius relative to the longitudinal axis and at least a second portion of the inner radial surface has a second radius relative to the longitudinal axis. The first radius is greater than the second radius. The locking hub also includes at least one pad between the sleeve and the first hub or the second hub. The at least one pad has a compressed state and a relaxed state. The at least one pad is in the compressed state when rotationally aligned with the second portion and in the relaxed state when rotationally aligned with the first portion. The weight plate may be connected to the sleeve or may be integrally formed with the sleeve, such that the inner radial surface of the sleeve is the inner radial surface of the weight plate. The bar has a grip portion, a weight portion, and a weight stop located between the grip portion and weight portion. The weight stop has a stop outer axial surface toward the weight portion with one or more bar engagement features. The bar engagement features may be connected to the outer axial surface and configured to engage with the one or more first engagement features of the locking hub.

In yet another non-limiting embodiment, a method of use of a locking hub as described herein includes providing a locking hub according to the present disclosure in an unlocked state and positioning the locking hub on a bar or other object extending through an axis of the locking hub. The method includes rotating a first hub of the locking hub relative to a sleeve and compressing a pad against the bar or other object and thereby restricting or substantially preventing lateral movement of the locking hub relative to the bar or other object.

Additional features of embodiments of the disclosure will be set forth in the description which follows. The features of such embodiments may be realized by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

One or more specific embodiments of the present disclosure will be described below. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

One or more embodiments of the present disclosure may generally relate to securing an object about a bar located therethrough. More particularly, one or more embodiments of the present disclosure may relate to securing weight plates on exercise equipment.

Figure 1:
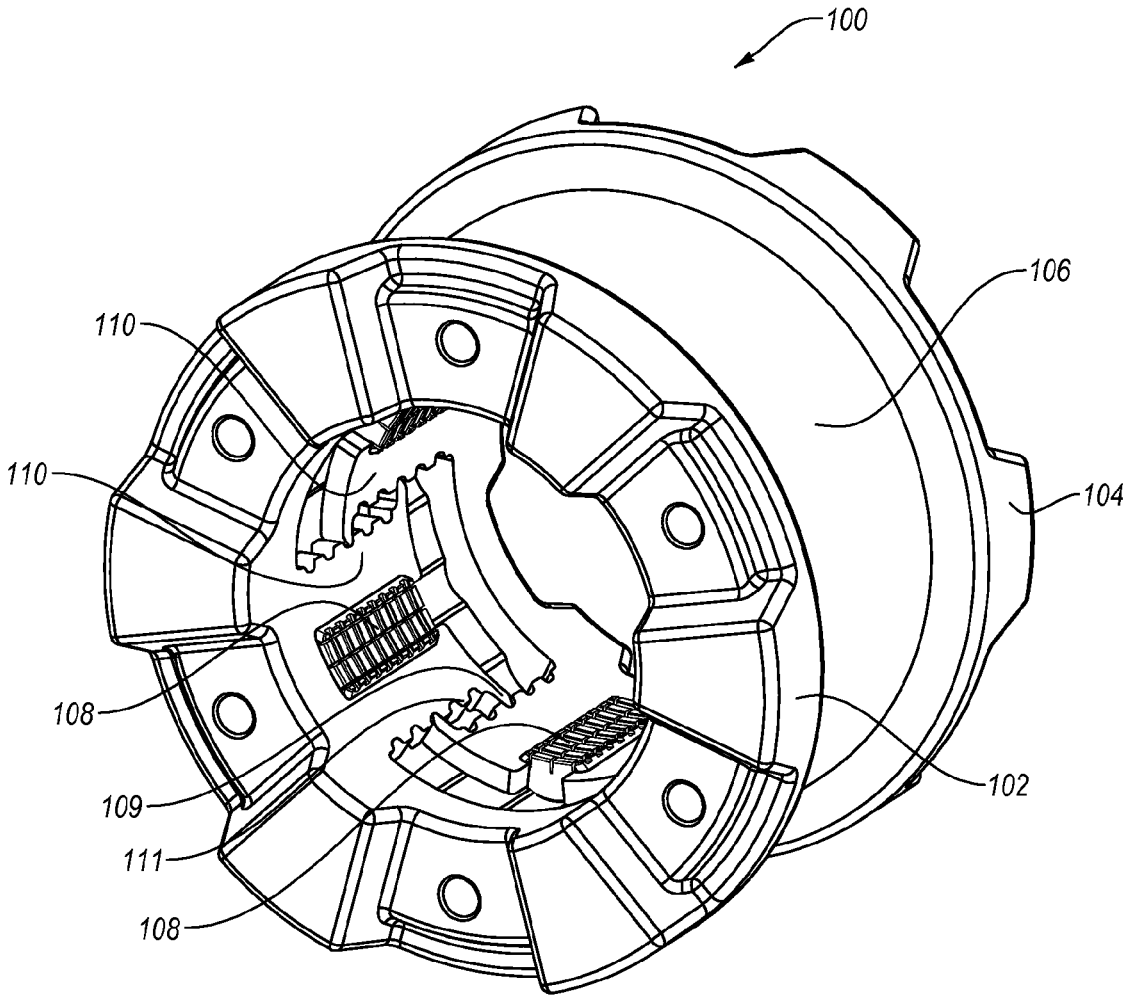
FIG. 1 is a perspective view of a locking hub, according to one or more embodiments disclosed herein.

FIG. 1 is a perspective view of an embodiment of a locking hub 100. The locking hub 100 may include a first hub 102 and a second hub 104. The first hub 102 and second hub 104 may have a sleeve 106 located therebetween. The first hub 102 and/or second hub 104 may be made of and/or include various materials including metals, plastics, ceramics, or combinations thereof. In an embodiment, the first hub 102 and/or second hub 104 may be made of and/or include a metal such as steel alloys, aluminum alloys, titanium alloys, other alloys, other metals, or combinations thereof. In another embodiment, the first hub 102 and/or second hub 104 may be made of and/or include a plastic such as a molded or machined thermoplastic such as styrenic block copolymers, elastomeric alloys, thermoplastic polyurethanes, thermoplastic copolyesters, or thermoplastic polyamides; or thermosetting polymer such as polyurethane, fiberglass, or resins. The first hub 102 and/or second hub 104 may have one or more pads 108 contained therein. The pads 108 may be made of and/or include a molded or machined thermoplastic such as styrenic block copolymers, elastomeric alloys, thermoplastic polyurethanes, thermoplastic copolyesters, or thermoplastic polyamides.

The first hub 102 and/or second hub 104 may include one or more retention members 110. The retention members 110 may be connected to a surface of the first hub 102 and/or second hub 104. In another embodiment the retention members 110 may be integrally formed with the first hub 102 and/or second hub 104. In an embodiment, the retention members 110 may extend from an inner axial surface of the first hub 102 and/or second hub 104. In another embodiment, the retention members 110 may be connected to or integrally formed with a radial surface of the first hub 102 and/or second hub 104 and extend axially. The retention members 110 may limit movement of the pads 108 relative to the retention members 110 and, therefore, limit movement of the pads 108 relative to the first hub 102 and/or second hub 104.

The retention members 110 may limit movement of the first hub 102 and second hub 104 relative to one another. In some embodiments, the retention members 110 may include mating features 109 located thereon. The mating features 109 may allow the retention members 110 to engage with and lock to one or more complimentary features 111 on another retention member 110. For example, the retention members 110 may include a plurality of complimentary features 111 at various axial positions relative to the locking hub 100 such that the locking hub 100 may have a variable length such that it may accommodate varying lengths of a sleeve 106. The adjustable length of locking hub 100 allows the locking hub 100 to be used with weight plates of varying thicknesses. The mating features 109 may engage with the complimentary features 111 by a press fit, a snap fit, a friction fit, an adhesive, a material bond, one or more threads, or combinations thereof. In other embodiments, the mating features 109 may engage with and lock to complimentary features 111 located on other components, such as a first hub 102 and/or second hub 104.

Figure 2:
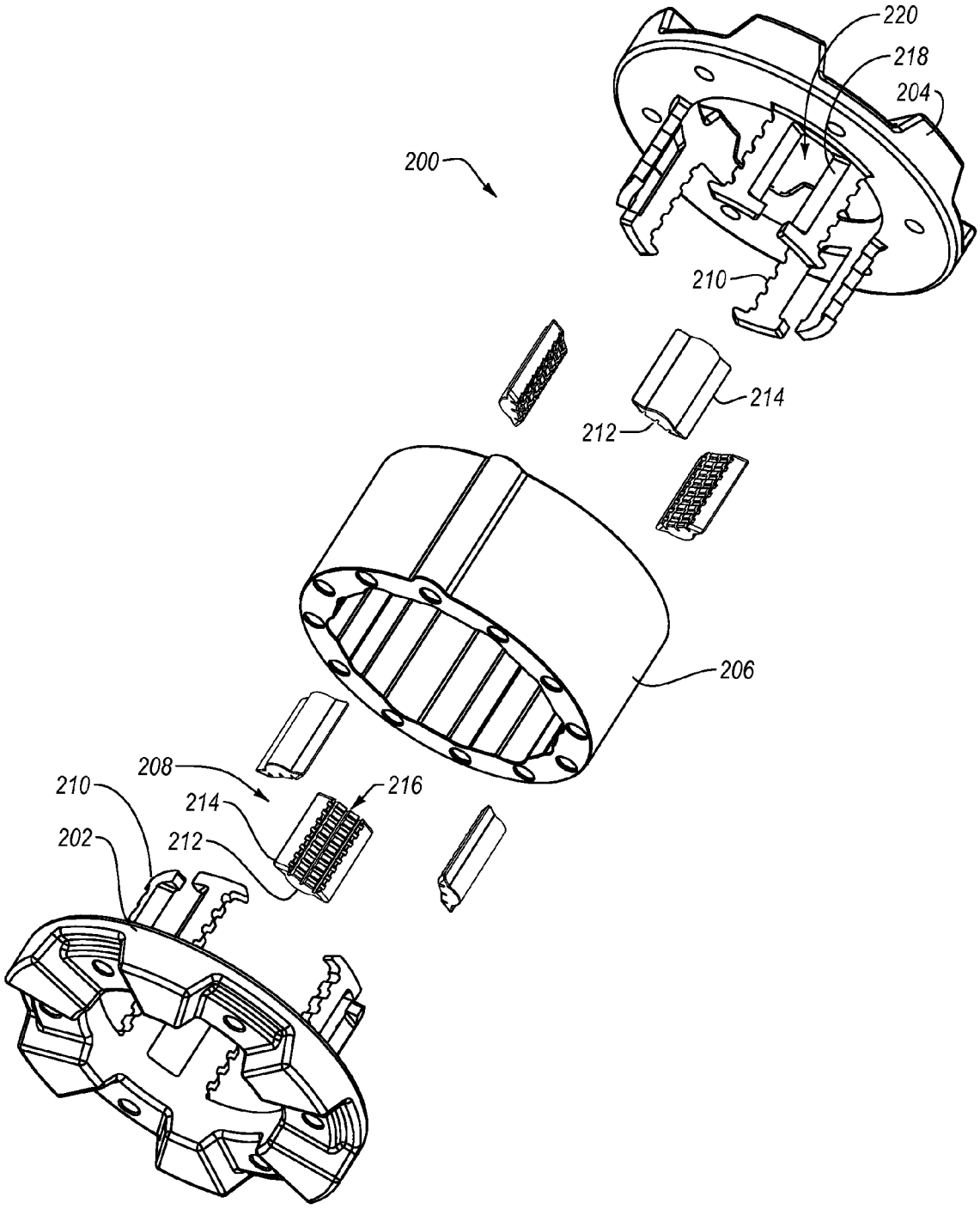
FIG. 2 is a perspective exploded view of a locking hub, according to one or more embodiments disclosed herein.

FIG. 2 is an exploded view of a locking hub 200. FIG. 2 depicts the relative position of the components of the locking hub 200. A sleeve 206 is located between a first hub 202 and second hub 204. The first hub 202 and/or second hub 204 may include one or more retention members 210. In some embodiments, the first hub 202 may include three retention members 210 and the second hub 204 may include three retention members 210. Each retention member 210 may align with and/or be associated with a pad 208. Each pad 208 may include a body 212 and wings 214. In some embodiments, the body 212 and wings 214 may be integrally formed with one another. For example, in the depicted embodiment, the body 212 and wings 214 are injection molded as a continuous piece. The pad 208 may include a textured surface 216 such that a surface of the body 212 and/or wings 214 may have an increased coefficient of friction relative to an untextured surface.

The body 212 of the pad 208 may align with a channel 220 in the retention member 210. In some embodiments, the body 212 may protrude from the channel 220. In other embodiments, the body 212 may be flush with a surface of the retention member 210 or recessed with the channel 220. The wings 214 of the pad 208 may be aligned with and/or contact one or more sloped surfaces 218 of the retention member 210. The sloped surface 218 may be curved and/or substantially planar. The sloped surface 218 may have a portion that forms an angle with a surface of the associated retention member 210 in a range having upper and lower values including 10°, 20°, 30°, 40°, 50°, 60°, 70°, 80°, or any value therebetween. For example, the sloped surface 218 may have a portion that forms an angle with a surface of the associated retention member 210 in a range between 20° and 70°, between 30° and 60°, or between 35° and 55°. The sloped surfaces 218 may apply a radial force to the pad 210 to limit or, in some instances, prevent movement of the pad 210 in a radial direction relative to the sleeve 206. The sloped surfaces 218 may apply a lateral force to the pad 210 to limit or, in some instances, prevent movement of the pad 210 in a lateral and/or rotational direction relative to the sleeve 206.

Figure 3:
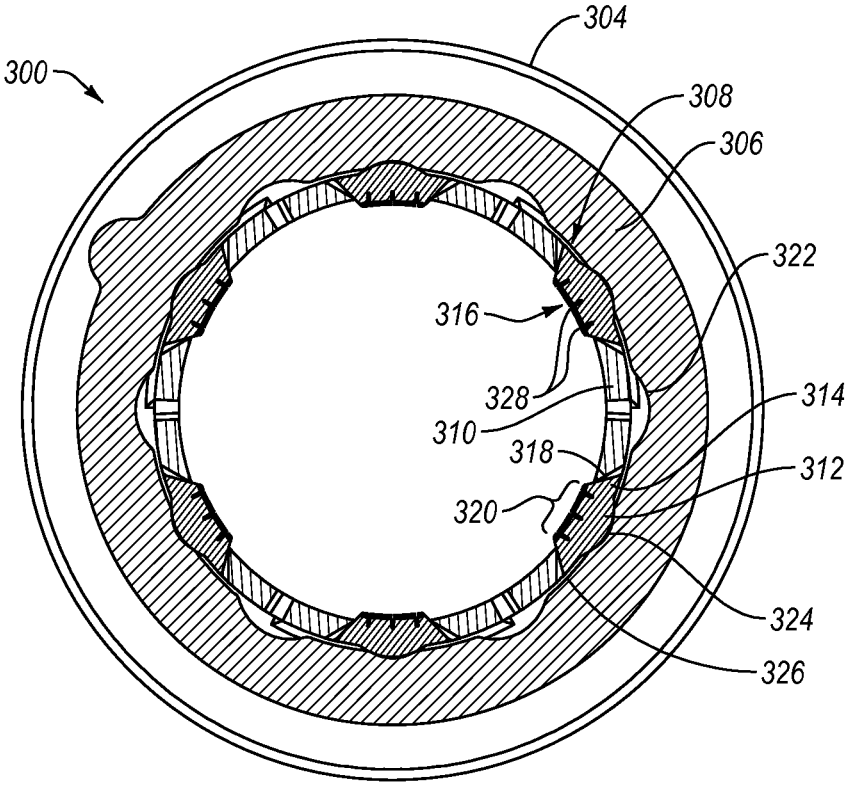
FIG. 3 is a cross-sectional end view of a locking hub in a locked position, according to one or more embodiments disclosed herein.
Figure 4:
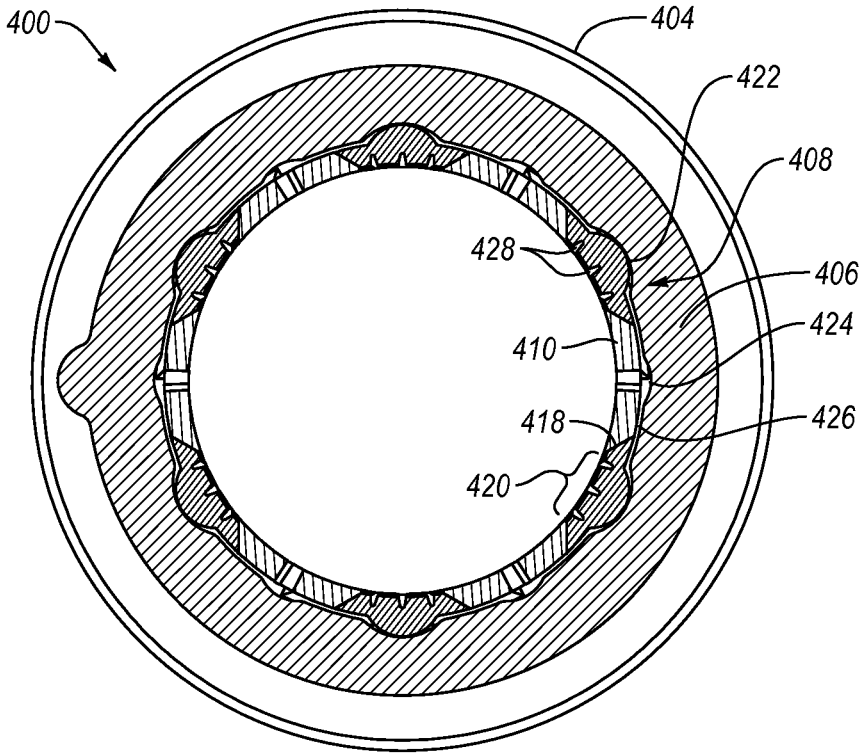
FIG. 4 is a cross-sectional end view of a locking hub in an unlocked position, according to one or more embodiments disclosed herein.

FIGS. 3 and 4 show cross-section views of locking hubs 300, 400, respectively. The cross-sectional view of locking hub 300 in FIG. 3 depicts the locking hub 300 in a locked state. The locking hub 300 may have a locked state and an unlocked state. A sleeve 306 located between a first hub (not shown) and a second hub 304 has more than one inner radius. In particular, the sleeve 306 may include a one or more unlocked recesses 322 and one or more locked recesses 324 in an inner radial surface 326. The one or more unlocked recesses 322 may be a portion of the inner radial surface 326 having a first radius. The one or more locked recesses 324 may be a portion of the inner radial surface 326 having a second radius. The first radius may be greater than the second radius.

In other embodiments, the sleeve 306 may include one or more protrusions (not shown) extending radially inward from the inner radial surface 326 such that a first portion of the inner radial surface 326 has a first radius, and a second portion of the inner radial surface 326 has a second radius. In yet other embodiments a combination of both protrusions (not shown) and recesses 322 and/or 324 may be used to create varying radii for the inner radial surface 326. The body 312 of the pad 308 may include one or more recesses (not shown). The recesses in the body 312 may complimentarily mate with the protrusions on the inner radial surface 326 when in the locked and/or unlocked position. The protrusions in the inner radial surface 326 may apply a force to the pads 308 when not aligned with the one or more recesses in the body 312 such that the pads are in a compressed state. When aligned with the one or more recesses in the body 312, the one or more protrusions may apply less or substantially no force to the pads 308 such that the pads may be in a relaxed state.

FIG. 3 shows a pad 308 in a compressed state. In a compressed state, the sleeve 306 may be rotated relative to the locking hub 300 such that at least one of the locked recesses 324 is substantially aligned with a body 312 of a pad 308. Each pad 308 may be at least partially within a retention member 310. The radial inner surface 326 of the sleeve 306 may apply a force to the pad 308 radially inward. The sloped surfaces 318 of the retention member 310 may apply a force to the pad 308 having a component radially outward and a component toward the body 312. The pad 308 may compress at least partially due to the force applied by the sloped surface 318. The pad 308 may compress and extend through the channel 320 of the retention member 310. The channel 320 may be open and allow the pad 308 to extend beyond a surface of the retention member 310 such that the pad 308 may engage another object, such as a weight bar as will be described in relation to FIG. 10, and apply a frictional force thereto to limit motion of the locking hub 300 relative to the object. The body 312 of the pad 308 may include one or more relief cuts 328 in a surface thereof. The relief cuts 328 may facilitate preferred compression of a portion of the pad 308 against another, such as a bar. For example, the relief cuts 328 may be longitudinal cuts in a surface of the body 312 that allow for more lateral compression (i.e., perpendicular to the longitudinal cuts) than compression in another direction relative to the body 312.

In other embodiments, the sleeve 306 may include unlocked recesses 322 and have a constant radius of the inner radial surface 326 therebetween. For example, the sleeve 306 may not include locked recesses 324. In such an embodiment, the inner radial surface 326 may apply a force radially inward against the pads 308 such that the pads 308 may be in a compressed state. The unlocked recesses 322 may be distributed evenly about the circumference of the inner radial surface 326 of the sleeve. The unlocked recesses 322 may, therefore, provide one or more unlocked positions of the locking hub 300 in which the sleeve 306 is oriented at one or more predetermined positions relative to the first hub 302 and/or second hub 304. All other positions of the sleeve 306 relative to the first hub 302 and/or second hub 304 may result in the locking hub 300 being in a locked state.

FIG. 4 shows a pad 408 in a relaxed state. In a relaxed state, a sleeve 406 of a locking hub 400 rotated relative to a first hub (not shown) and a second hub 404 such that at least one of the unlocked recesses 422 of the radial inner surface 426 is substantially aligned with a body 412 of the pad 408. The unlocked recess 422 may have a radius that is larger than that of a locked recess 424. When in a relaxed state, the pad 408 may be in an uncompressed or less compressed state relative to a pad in a compressed state. One or more relief cuts 428 may expand when a radially inward force on the pad 408 is reduced or removed. The expansion of the relief cuts 428 may encourage a preferred lateral expansion of the body 412 against the sloped surfaces 418 of the retention members 410. The expansion of the body 412 against the sloped surface 418 of the retention member 410 may urge the pad 408 toward the sleeve 406. In some embodiments, a portion of the pad 408 may protrude from the channel 420. In other embodiments, a portion of the pad 408 may extend from the channel 420 and the body 412 may be flush with or recessed from radial inner surface of the retention members 410.

One or more of the locked recesses 424 and/or one or more of the unlocked recessed 422 may include a curved surface relative to the radial inner surface 426. In an embodiment, one or more of the locked recesses 424 and/or one or more of the unlocked recessed 422 may be radially symmetrical relative to the sleeve 406 such that the pad 408 will expand and preferentially rest substantially centered in one or more of the locked recesses 424 and/or one or more of the unlocked recessed 422. In such an embodiment, the sleeve 406 may be rotated relative to the first hub and/or second hub 404 in either rotational direction (i.e., clockwise and counterclockwise). A force applied between the pads 408 and the sleeve 406 may be substantially equal in either direction. In another embodiment, one or more of the locked recesses 424 and/or one or more of the unlocked recessed 422 may be radially asymmetrical relative to the sleeve 406 such that compression of the pad 408 may be more gradual and/or easier when moving the sleeve 406 and pad 408 relative to one another in a first direction when compared to moving the sleeve 406 and the pad 408 relative to one another in a second direction. One or more of the locked recesses 424 and/or one or more of the unlocked recessed 422 being radially asymmetrical may create a tactile feel for a user that there is a preferred rotational direction for entering and/or exiting a locked and/or unlocked state of the locking hub 400.

Figure 5:
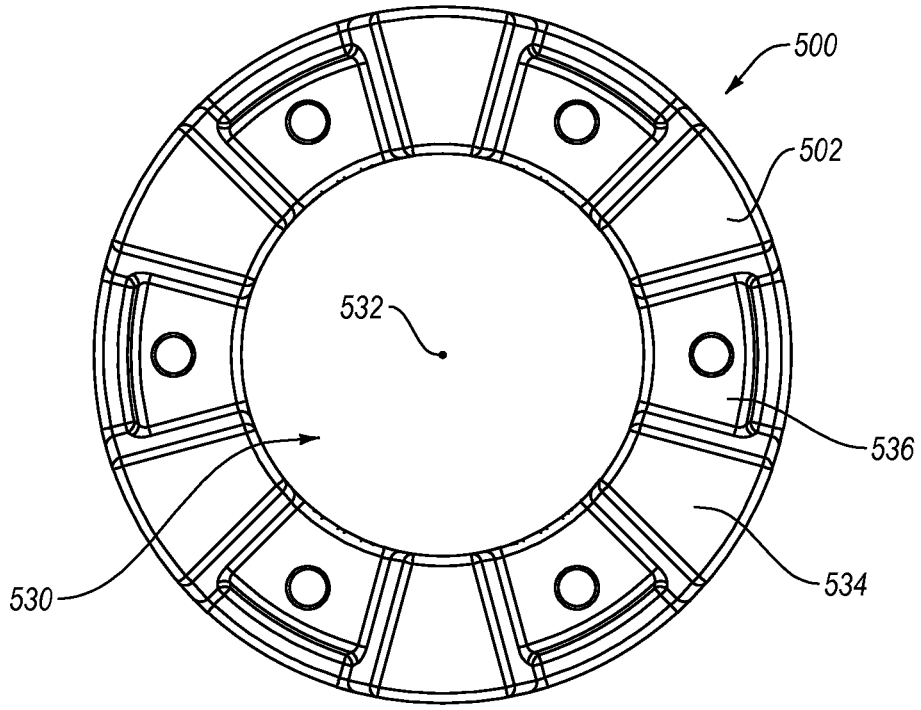
FIG. 5 is an end view of a locking hub including engagement features, according to one or more embodiments disclosed herein.

FIG. 5 is an exterior side view of a locking hub 500. The locking hub 500 may include an axial bore 530 having a longitudinal axis 532 therethrough. The locking hub 500 may include first hub 502 having one or more engagement features 534. The one or more engagement features 534 may be spaced evenly about a circumference of the first hub 502. The one or more engagement features 534 may be separated by one or more engagement spaces 536 spaced evenly about the circumference of the first hub 502 and alternatingly with the engagement features 534. In other embodiments, the engagement features 536 may be spaced or otherwise located unevenly about the circumference of the first hub 502. It should be understood that while the engagement features 534 and the associated engagement spaces 536 are described and depicted in relation to the first hub 502, the engagement features 534 and the associated engagement spaces 536 may also be located on a corresponding second hub as shown in FIG. 6.

Figure 6:
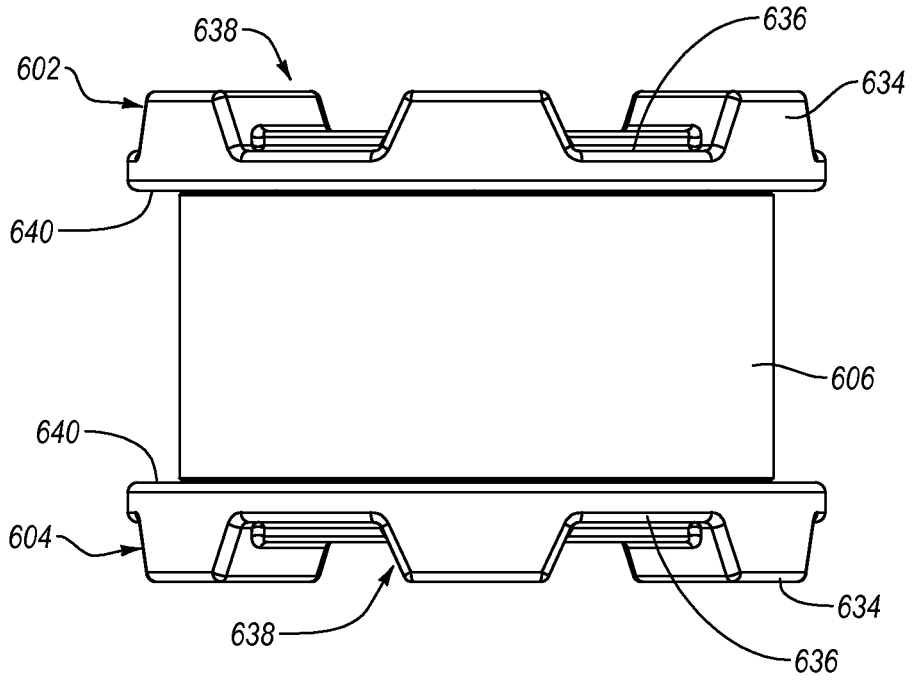
FIG. 6 is a side view of a locking hub including engagement features, according to one or more embodiments disclosed herein.

FIG. 6 depicts a locking hub 600 having a first hub 602 and a second hub 604. The first hub 602 may have a plurality of engagement features 634 and engagement spaces 636. The second hub 604 may have a plurality of engagement features 634 and engagement spaces 636. The first hub 602 may have an outer axial surface 638 and an inner axial surface 640. The engagement features 634 and engagement spaces 636 may be located on the outer axial surface 638 and the inner axial surface 640 may be proximate and/or abutting a sleeve 606. Similarly, the second hub 604 may have an outer axial surface 638 and an inner axial surface 640. The engagement features 634 and engagement spaces 636 may be located on the outer axial surface 638 and the inner axial surface 640 may be proximate and/or abutting a sleeve 606.

As shown in FIG. 6, the first hub 602 and second hub 604 may be similar or identical. In some embodiments, the first hub 602 and second hub 604 of the locking hub 600 may be substantially rotationally aligned. For example, the engagement features 634 of the first hub 602 may be substantially rotationally aligned (i.e., may fall along a common longitudinal line) with the engagement features 634 of the second hub 604. In other embodiments, the first hub 602 and second hub 604 may not be similarly rotationally aligned. For example, the engagement features 634 of the first hub 602 may substantially align with the engagement spaces 636 of the second hub 604. In yet other embodiments, the engagement features 634 of the first hub 602 and second hub 604 may not align with any feature or space on the first hub 602 and/or second hub 604.

Figure 7:
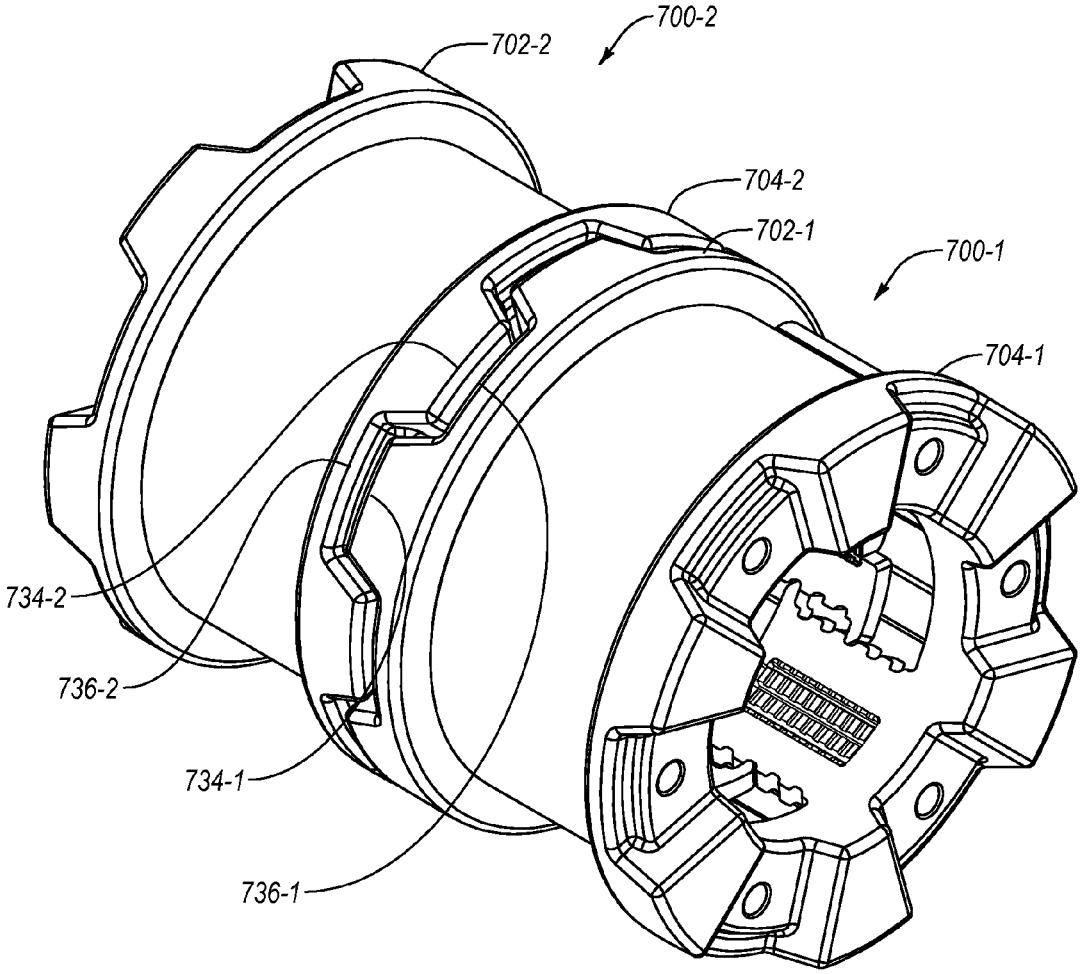
FIG. 7 is a perspective view of two locking hubs including engagement features that are engaged, according to one or more embodiments disclosed herein.

FIG. 7 depicts a pair of locking hubs 700-1, 700-2 engaged with one another. In an embodiment, a first locking hub 700-1 and a second locking hub 700-2 may be similar or identical to one another. For example, first locking hub 700-1 may share all components with second locking hub 700-2, such that first locking hub 700-1 and/or second locking hub 700-2 may engaged in the described fashion with any number of similar locking hubs a user may use.

The first locking hub 700-1 and/or second locking hub 700-2 may each have a first hub 702-1, 702-2 and a second hub 704-1, 704-2, respectively. In the depicted embodiment, the first hub 702-1, 702-2 and a second hub 704-1, 704-2 may be identical and/or interchangeable (e.g., first locking hub 700-1 may be inverted without altering the function of the first locking hub 700-1) and, therefore, it should be understood that "first hub" and "second hub" are merely used as directional indicators relative to depicted positions. The first locking hub 700-1 may engage with the second locking hub 700-2. Engagement features 734-1 of the first locking hub 700-1 may engage with the engagement features 734-2 of the second locking hub 700-2. In the depicted embodiment, the engagement features 734-1 of the first locking hub 700-1 may substantially mate with the engagement spaces 736-2 of the second locking hub 700-2. The engagement features 734-2 of the second locking hub 700-2 may substantially mate with the engagement spaces 736-1 of the first locking hub 700-1.

The interlocking engagement of the locking hubs 700-1, 700-2 may facilitate the locking/unlocking of the hubs 700-1, 700-2. For example, the interlocking engagement of the locking hubs 700-1, 700-2 may rotationally fix the first hub 702-1 of the first locking hub 700-1 with the second hub 704-2 of the second locking hub 700-2. While the first hub 702-1 of the first locking hub 700-1 is engaged with the second hub 704-2 of the second locking hub 700-2, the second locking hub 700-2 may be moved into a locked state and/or an unlocked state without a user manually fixing the position of the first hub 702-2 and/or second hub 704-2 (e.g., when a plurality of locking hubs are aligned and engaged in series when on a weight bar as will be described in more detailed in relation to FIG. 10).

Figure 8:
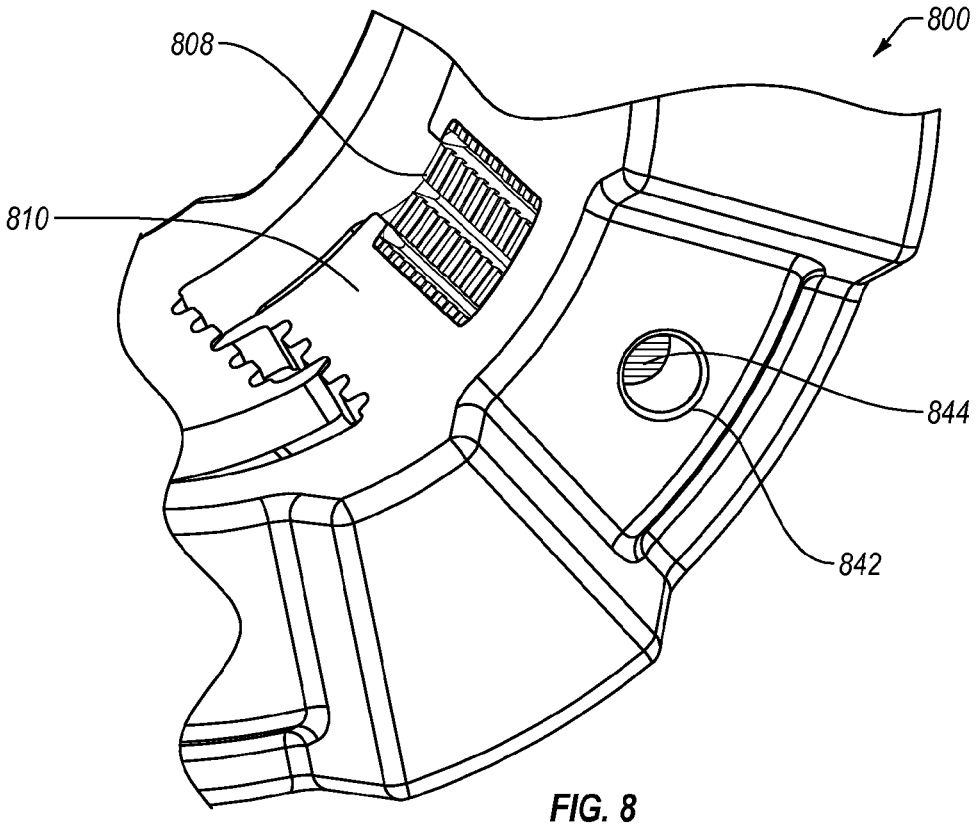
FIG. 8 is a perspective cutaway view of a locking hub having a visual indicator in an unlocked position, according to one or more embodiments disclosed herein.
Figure 9:
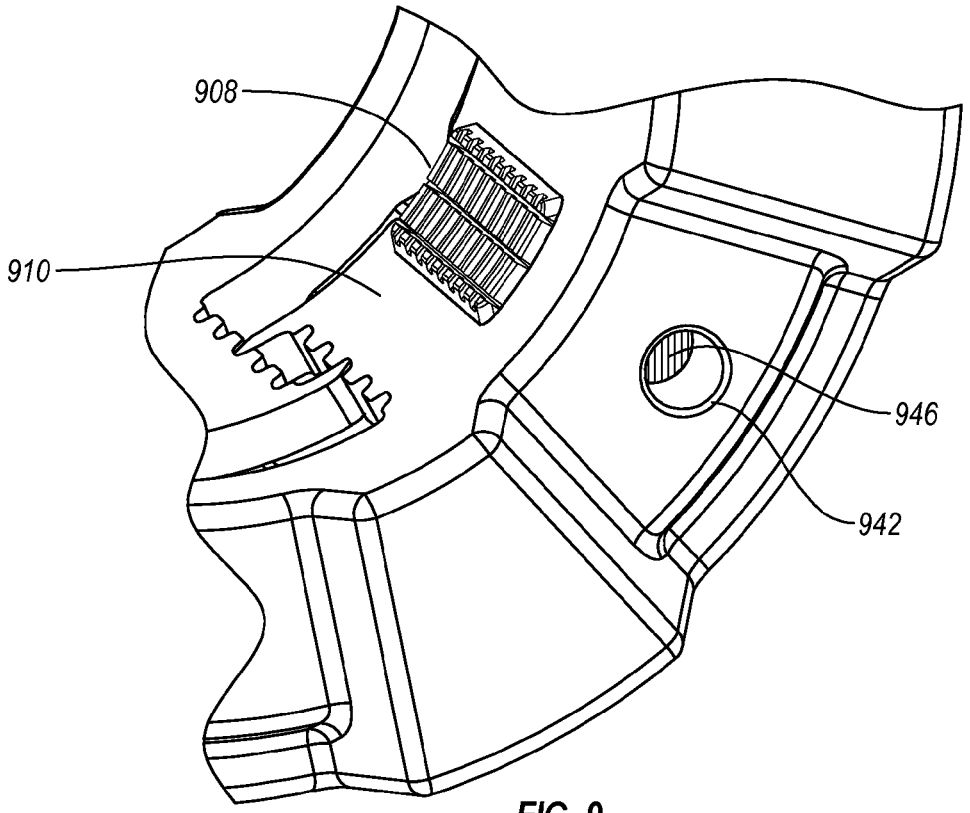
FIG. 9 is a perspective cutaway view of a locking hub having a visual indicator in a locked position, according to one or more embodiments disclosed herein.

FIGS. 8 and 9 are cutaway views of locking hubs 800, 900 that include visual indicators 842, 942 to indicate when the locking hub 800, 900 is in a locked state and/or an unlocked state. As shown in FIG. 8, the locking hub 800 may include a visual indicator 842. In some embodiments, the visual indicator 842 may include an opening and a pattern, color, light, other selectable visual cue, or combinations thereof visible through the opening. In other embodiments, the visual indicator may include a pattern, color, light, display, readout, or other selectable visual cue located on a surface of the locking hub. In FIG. 8, the locking hub 800 is depicted in an unlocked state with a pad in a relaxed state flush with and/or recessed within a surface of a retention member 810. A first visual cue 844 may be visible in the visual indicator 842 when the locking hub 800 is in an unlocked state.

As shown in FIG. 9, a second visual cue 946 may be visible through a visual indicator 942 when a locking hub 900 is in a locked state. A pad 908 may be in a compressed state and protrude from a retention member 910 when the second visual cue 946 is visible through the visual indicator. For example, the first visual cue 844 in FIG. 8 and the second visual cue 946 in FIG. 9 may be located on a sleeve (not shown). When the sleeve is moved relative to the visual indicator 842, 942, the first visual indicator 844 and the second visual indicator 946 may move with the sleeve, becoming selectively visible in association with the relative position of the sleeve. The relative position of the sleeve may at least partially determine whether the pad 908 is in a compressed or relaxed state and, hence, whether the locking hub 900 is in a locked or unlocked state. The visual indicator 942 may thereby provide a visual indication as to the state of the locking hub 900.

Figure 10:
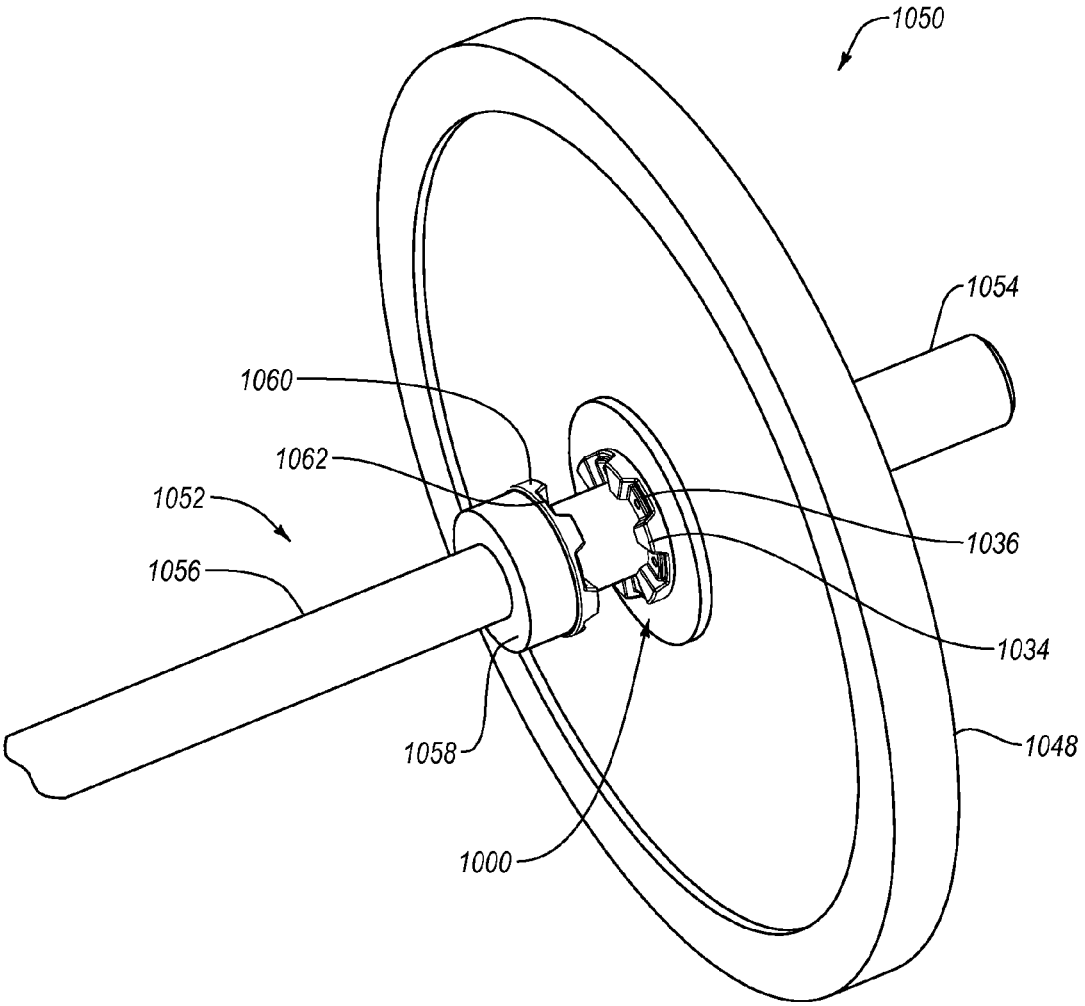
FIG. 10 is a perspective cutaway view of a free weight system including a locking hub, according to one or more embodiments disclosed herein.

FIG. 10 depicts a system 1050 including a locking hub 1000 located between a weight plate 1048 and a weight bar 1052. The weight bar 1052 may include a weight portion 1054 and a grip portion 1056. A user may load weight plates 1048 onto the weight portion 1054 of the weight bar 1052 prior to a weight training exercise while the locking hub 1000 is in an unlocked state. The weight bar 1052 may include a weight stop 1058 that is positioned between the grip portion 1056 and the weight portion 1054. The weight stop 1058 may include one or more bar engagement features 1060 and/or bar engagement spaces 1062 on an outer axial surface thereof. The bar engagement features 1060 may be configured to engage with the engagement features 1034 and/or engagement spaces 1036 of the locking hub 1000.

The locking hub 1000 may be located within an axial bore of the weight plate 1048. In an embodiment, the locking hub 1000 may be connected to the weight plate 1048 by a press fit, a friction fit, an adhesive, one or more threads, a material bond, or combinations thereof such that the weight plate 1048 and a sleeve (not shown) may be rotationally fixed relative to one another. In other embodiments, the locking hub 1000 may be at least partially integrally formed with the weight plate 1048. For example, the sleeve may be integrally formed with the weight plate 1048 and/or an inner radial surface of the weight plate 1048 may directly contact the pads (not shown) of locking hub 1000.

The weight plate 1048 and locking hub 1000 may be placed on the weight portion 1054 of the weight bar 1052 such that the weight portion 1054 extends through an axial bore of the locking hub 1000 (see axial bore 530 in FIG. 5). The weight plate 1048 and locking hub 1000 may be advanced on the weight portion 1054 until the locking hub 1000 contacts the weight stop 1058. In some embodiments, the engagement features 1034 of the locking hub may engage the bar engagement features 1060 when the locking hub 1000 is adjacent the weight stop 1058. The bar engagement features 1060 may rotationally fix the engagement features 1034 of the locking hub 1000 relative to the weight bar 1052. A user may then rotate the weight plate 1048 relative to the weight bar 1052 until the locking hub 1000 reaches a locked state, which may be indicated by a visual indicator such as described in relation to FIGS. 8 and 9, or until the user feels a tactile change in the resistance of the locking hub 1000 as the pads move between unlocked and locked recesses as described in relation to FIGS. 3 and 4.

In an embodiment including a plurality of weight plates 1048 on a weight portion 1054, an outermost weight plate 1048 may partially or substantially limit the lateral movement of one or more inner weight plates. In such an embodiment, the interlocking engagement of the plurality of locking hubs 1000 may rotationally fix all of the first and/or second hubs relative to the weight bar 1052 (as described in relation to FIG. 7). The outermost weight plate 1048 may be rotated relative to the weight bar 1052 to move the locking hub 1000 to a locked state.

Figure 11:
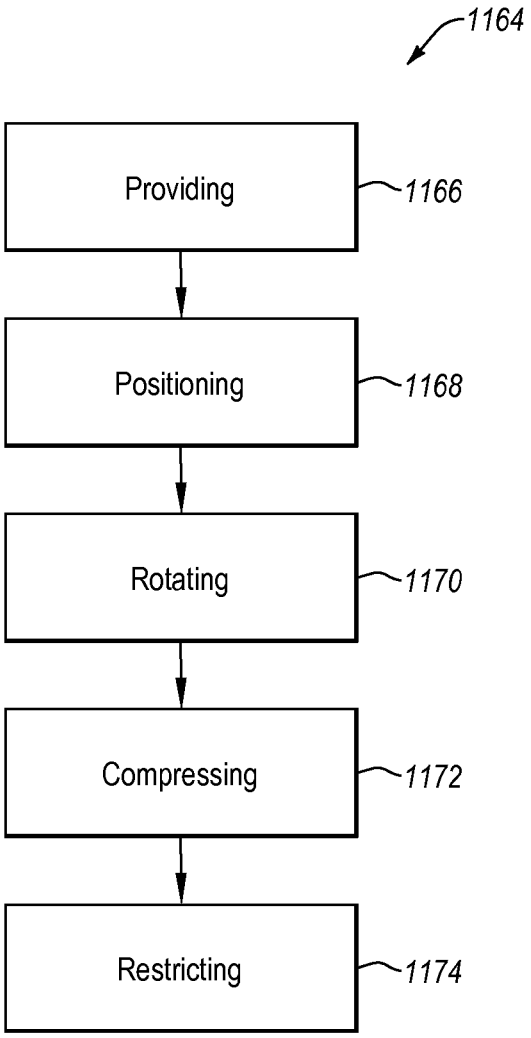
FIG. 11 is a flowchart depicting a method of use of a locking hub according to one or more embodiments disclosed herein.

A method 1164 of use, as shown in FIG. 11, may include providing 1166 a locking hub according to the present disclosure in an unlocked state and positioning 1168 the locking hub on a bar or other object extending through an axis of the locking hub. The method 1164 may include rotating 1170 a first hub of the locking hub relative to a sleeve and compressing 1172 a pad against the bar or other object and thereby restricting 1174 or substantially preventing lateral movement of the locking hub relative to the bar or other object. The method 1164 may also include rotating the first hub of the locking device and relaxing the pad from the bar or other object to ease movement of the locking hub relative to the bar or other object. In doing so, a locking hub according to the present disclosure may effectively and reliably retain one or more weight plates on a weight bar with an integrated locking mechanism.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A system for limiting movement of a weight plate relative to a weight bar, the system comprising:

a locking device comprising:

a first hub having a first outer radial surface, a first inner radial surface, a first outer axial surface, a first inner axial surface, a longitudinal axis, and one or more first engagement features on the first outer axial surface, a second hub having a second outer radial surface, a second inner radial surface, a second outer axial surface, a second inner axial surface, and sharing the longitudinal axis, the second inner axial surface opposing the first inner axial surface, a sleeve located adjacent to the first and second outer radial surfaces and rotatable relative to the first hub and second hub, the sleeve having a third inner radial surface and a third outer radial surface, at least a first portion of the third inner radial surface having a first radius relative to the longitudinal axis and at least a second portion of the third inner radial surface having a second radius relative to the longitudinal axis, the first radius being greater than the second radius, an axial bore extending through the first hub, second hub, and the sleeve, the axial bore sharing the longitudinal axis, and at least one pad, wherein the at least one pad has a compressed state and a relaxed state and the at least one pad is in the compressed state when rotationally aligned with the second portion and is in the relaxed state when rotationally aligned with the first portion; and a bar having a grip portion, a weight portion and a weight stop located between the grip portion and weight portion, the weight stop having a stop outer axial surface toward the weight portion, wherein at least part of the weight portion is located within the axial bore.

2. The system of claim 1, further comprising a weight plate having a plate bore therethrough, at least part of the locking device located within the plate bore.

3. The system of claim 2, wherein the sleeve is integrally formed with the weight plate.

4. The system of claim 1, the stop outer axial surface of the bar further comprising one or more bar engagement features connected thereto and configured to engage with the one or more first engagement features of the locking device.

5. The system of claim 4, wherein the bar engagement features are integrally formed with the bar.

6. The system of claim 1, the first hub further comprises a first retention member and wherein the second hub further comprises a second retention member, the first and second retention members being configured to limit rotational movement of the at least one pad relative to the first and second hubs, wherein the first retention member and second retention member are configured to mutually engage and limit movement of the first and second hub relative to one another.

* * * * *